US006512897B2

(12) United States Patent
Matsumoto

(10) Patent No.: US 6,512,897 B2
(45) Date of Patent: Jan. 28, 2003

(54) DEVELOPING DEVICE, PROCESS CARTRIDGE, AND ELECTROPHOTOGRAPHIC IMAGE FORMING APPARATUS

(75) Inventor: Hideki Matsumoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/871,621

(22) Filed: Jun. 4, 2001

(65) Prior Publication Data

US 2002/0009303 A1 Jan. 24, 2002

(30) Foreign Application Priority Data

Jun. 6, 2000 (JP) ..... 2000-169001
May 17, 2001 (JP) ..... 2001-148226

(51) Int. Cl.[7] ..... G03G 15/08
(52) U.S. Cl. ..... 399/27; 399/274; 399/284
(58) Field of Search ..... 399/27, 61, 264, 399/273, 274, 283, 284, 111

(56) References Cited

U.S. PATENT DOCUMENTS 5,517,286 A * 5/1996 Tada et al. ..... 399/274
5,649,197 A * 7/1997 Fujita ..... 399/284 X
5,802,419 A * 9/1998 Sakurai et al. ..... 399/27 X
5,913,094 A * 6/1999 Endo ..... 399/274 X
6,253,036 B1 6/2001 Karakama et al. ..... 399/27
6,259,878 B1 * 7/2001 Sato et al. ..... 399/284

FOREIGN PATENT DOCUMENTS

JP 01-282582 * 11/1989
JP 8-146764 6/1996
JP 2001-194898 7/2001

* cited by examiner

*Primary Examiner*—Sophia S. Chen
(74) *Attorney, Agent, or Firm*—Fitzpatrick, Cella, Harper & Scinto

(57) ABSTRACT

A developing device used for the main body of an electrophotographic image forming apparatus to develop an electrostatic latent image formed on an electrophotographic photosensitive member includes a developer bearing member for supplying developer to the electrophotographic photosensitive member to develop the electrostatic latent image formed on the electrophotographic photosensitive member, a developer regulating member for regulating the amount of developer adhering to the surface of the developer bearing member, an electrode member arranged in the traveling route of the developer removed from the surface of the developer bearing member by the developer regulating member to guide the traveling toner in the direction away from the developer bearing member, and a developer in-flow restricting member arranged for preventing the developer from flowing into the surface on the side opposite to the surface of the developer regulating member facing the developer bearing member.

13 Claims, 10 Drawing Sheets

PRIOR ART

DEVELOPING DEVICE, PROCESS CARTRIDGE, AND ELECTROPHOTOGRAPHIC IMAGE FORMING APPARATUS

BACKGROUND OF THE INVENTION

1. Field of the Invention

The present invention relates to an electrophotographic image forming apparatus which generally forms an electrostatic latent image by an electrophotographic method on an electrophotographic photosensitive member, and visualizes the electrostatic latent image with developer contained in a developing device. The invention also relates to a developing device, and a process cartridge.

In this respect, as the electrophotographic image forming apparatus, there are included, for example, an electrophotographic copying machine, an electrophotographic printer (an LED printer, a laser beam printer, or the like, for instance), and an electrophotographic facsimile apparatus, among some others.

Also, as the process cartridge, there is the one in which the electrophotographic photosensitive member and at least one of charging means, developing means, and cleaning means are integrally made into a cartridge, which is detachably mountable on the main body of an electrophotographic image forming apparatus or the one in which the electrophotographic photosensitive member and at least developing means are integrally made into a cartridge, which is detachably mountable on the main body of an electrophotographic image forming apparatus.

2. Related Background Art

Conventionally, for an image forming apparatus using the electrophotographic image forming process, there has been adopted a process-cartridge method in which an electrophotographic photosensitive member and processing means that acts on the electrophotographic photosensitive member are integrally made into a cartridge, which is detachably mountable on the main body of an electrophotographic image forming apparatus. In accordance with such process cartridge method, the apparatus can be maintained by the user in person without depending on a service engineer, hence making it possible to enhance the operativity significantly. Thus, the process-cartridge method is widely used for the electrophotographic image forming apparatus.

For the electrophotographic image forming apparatus that adopts such a process-cartridge method, the user in person replaces cartridges. For this reason, a developer-amount detecting device is considered in order to notify the user of the depletion of developer.

FIG. 10 is a view which shows one example of the conventional developer-amount detecting device. This example illustrates the state in which a conductive rod member (hereinafter referred to as "electrode rod") 101 is installed in the interior of a developing container 105*d* of the developing device 105, and the electrode rod 101 and a developer bearing member 105*a* constitutes a capacitor. Thus, this method utilizes the capacitance value that changes in accordance with the amount of developer between the two electrodes 101 and 105*a*.

To describe further, the electrode rod 101 is extended in the horizontal direction in the interior of the developing container 105*d*, and arranged to be connected with a developer-remaining-amount detecting circuit 117 in the main body of the image forming apparatus when the process cartridge is mounted, thus detecting the amount of developer and notifying the user accordingly.

The nearer to the developer bearing member 105*a* the electrode rod 101 is positioned, the higher the accuracy in detecting the "blank areas in an image" where a bad image is created due to an insufficient amount of usable developer. Then, however, there is a tendency that the electrode rod 101 impedes the circulation of developer, and that the developer is easier to deteriorate or the circulation thereof may become inadequate, among some others.

Also, if the electrode rod is positioned away from the developer bearing member 105*a*, the circulation of developer is not impeded, but the detection accuracy of the "blank areas in an image" tends to be lowered.

Here, in conjunction with FIG. 11, a description will be provided of the relationship between the toner amount in the developing container 105*d* and the capacitance to be detected (the voltage value may also be usable equally). The capacitance changes not at all or by a small amount until the toner amount is reduced to a predetermined amount, and changes rapidly thereafter.

SUMMARY OF THE INVENTION

The present invention is designed with the further development of such conventional art as has been described above.

It is an object of the invention to provide a developing device capable of enhancing the detection accuracy of the toner-remaining amount without degrading the image quality, as well as a process cartridge and an electrophotographic image forming apparatus.

It is another object of the invention to provide a developing device capable of further enhancing the detection accuracy of the creation of "blank areas in an image" without exerting any influence on an image, as well as a process cartridge and an electrophotographic image forming apparatus.

It is still another object of the invention to provide a developing device, a process cartridge, and an electrophotographic image forming apparatus, which comprises a developer bearing member for supplying developer to an electrophotographic photosensitive member to develop the electrostatic latent image formed on the electrophotographic photosensitive member; a developer regulating member for regulating the amount of developer adhering to the surface of the developer bearing member; an electrode member arranged in the traveling route of the developer removed from the surface of the developer bearing member by the developer regulating member to guide the traveling developer toward a direction away from the developer bearing member; and a developer in-flow restricting member arranged for preventing the developer from flowing into a side of a surface of the developer regulating member opposite to a surface of the developer regulating member opposed to the developer bearing member.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Hereinafter, in conjunction with the accompanying drawings, a description will be provided of a developing device, a process cartridge, and an electrophotographic image forming apparatus further in detail in accordance with the present invention.

Embodiment 1

A first embodiment will be described in accordance with the present invention.

Figure 1:
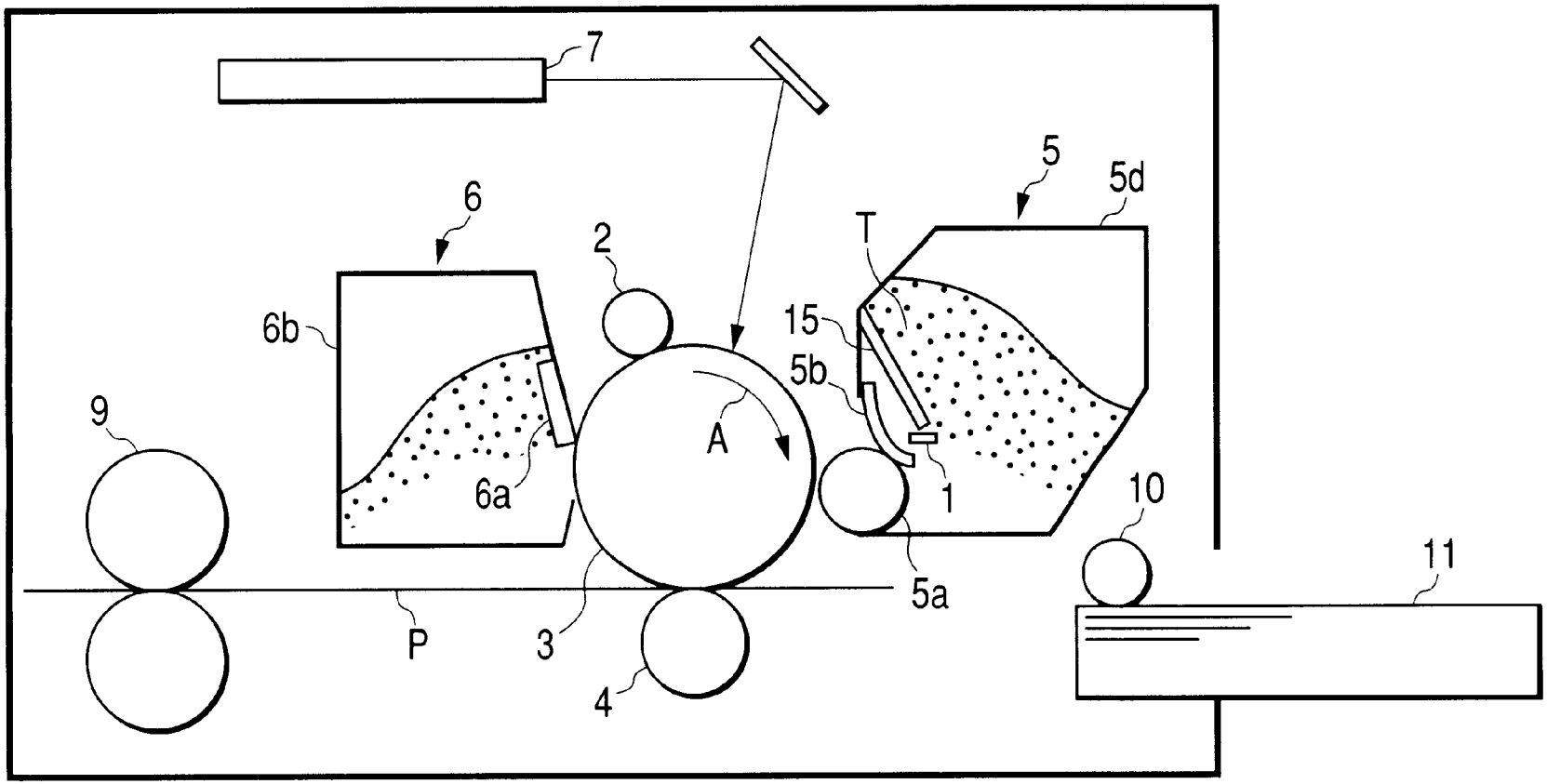
FIG. 1 is a view which schematically shows one embodiment of an electrophotographic image forming apparatus in accordance with the present invention.
Figure 2:
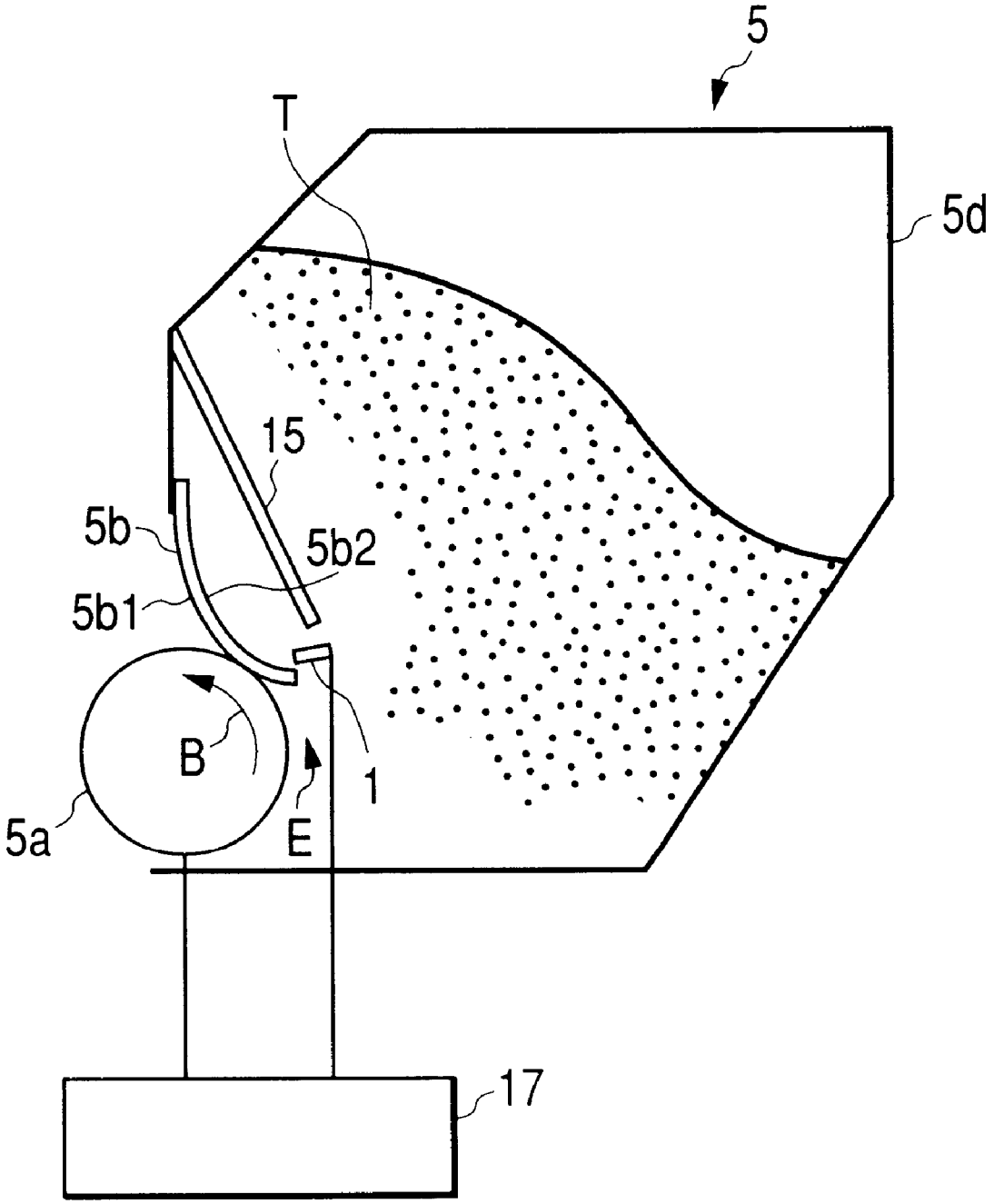
FIG. 2 is a view which schematically shows one embodiment of a developing device in accordance with the present invention.

At first, with reference to FIG. 1 and FIG. 2, a description will be provided of one embodiment of the electrophotographic image forming apparatus of the present invention.

The electrophotographic image forming apparatus of the present embodiment is a laser printer of the reversal-development type, which is provided with a photosensitive drum 3 serving as an electrophotographic photosensitive member almost in the central part of the apparatus main body, and on the periphery thereof; a charging device 2 for charging the photosensitive drum 3 uniformly; an exposing device 7 serving as means for forming an electrostatic latent image on the photosensitive drum 3; a developing device 5 for developing the electrostatic latent image on the photosensitive drum 3 by use of developer (toner) as the visual image, that is, a toner image; a transfer device 4 for transferring the toner image on the photosensitive drum 3 to a transfer material P; and a cleaning device 6 for removing residual toner remaining on the photosensitive drum 3 after transfer.

The developing device 5 is provided, as shown in FIG. 2, with a developing roller 5*a* serving as a rotatable developer bearing member to bear and convey developer (toner) T to a developing area; a developing blade 5*b* serving as a developer regulating member for regulating the amount of toner borne on the developing roller 5*a*; a hopper 5*d* serving as a developing container for containing toner T; and an electrode plate 1 serving as an electrode arranged in the longitudinal direction of the developing roller 5*a* in the vicinity of the developing roller 5*a*. In this respect, the portion of the developing blade 5*b*, which is near the distal end thereof, is in contact with the developing roller 5*a* in a counter direction to the rotational direction B of the developing roller 5*a*, and the distal end is away from the developing roller 5*a*. In this respect, the electrode plate 1 is arranged in the traveling route, on which the developer removed by the blade 5*b* from the surface of the roller 5*a* is to travel, for guiding the traveling developer in the direction away from the developing roller 5*a*. Also, a reference numeral 15 designates a developer in-flow restricting member which is arranged so as not to allow developer to flow into the side of the surface 5*b*2 of the blade 5*b* opposite to a surface 5*b*1 of the blade 5*b* opposed to the roller 5*a*. This restricting member 15 is extended on the back side of the blade 5*b* from the upper portion of the hopper 5*d* to the vicinity of the roller 5*a*. Then, the electrode plate 1 is an individual member made separately from the restricting member 15, and arranged with a gap to the restricting member 15.

With the structure described above, the photosensitive drum 3 rotates in the direction indicated by an arrow A at a process speed, and the photosensitive drum 3 is charged uniformly by the charging device 2. On the surface of the photosensitive drum 3 thus uiformly charged, an electrostatic latent image is formed by the exposing device 7 in accordance with the image information. Then, by the developing device 5, the electrostatic latent image is developed as the toner image.

On the other hand, inside a feed cassette 11, transfer material P is contained as recording medium. The transfer material P is fed one by one by a feed roller 10, and conveyed to the transfer nipping portion which is formed by the photosensitive drum 3 and the transfer device 4.

The toner image formed on the photosensitive drum 3 is transferred to a transfer material P by the transfer device 4 on the transfer nipping portion. The toner remaining on the photosensitive drum 3 after transfer is removed by the cleaning blade 6*a* and collected in a waste toner container 6*b*.

The transfer material P on which the toner image has been transferred is conveyed to a fixing device 9 where it is heated and pressed to have the toner image fixed, and then, delivered outside the apparatus.

Now, a description will be provided of a developer-amount detecting device in accordance with the present embodiment.

As shown in FIG. 2, the developer-amount detecting device of the present embodiment is provided with the electrode plate 1 serving as an electrode member arranged in parallel with and in the longitudinal direction of the developing roller 5*a* in the vicinity of the distal end of the developing blade 5*b*, and also, with a developer-remaining-amount detecting circuit 17 connected to the developing roller 5*a* and the electrode plate 1.

The electrode plate 1 is arranged to hold one end thereof in the widthwise direction and is in contact with the distal end of the developing blade 5*b*, while keeping it substantially horizontal as a whole, in the traveling route in which travels the toner that has been removed by the developing blade 5*b* from the vicinity of the surface of the developing roller 5*a*.

In the developer-remaining-amount detecting circuit 17, first a comparing circuit calculates a relationship as to large and small between an output voltage that corresponds to the capacitance between the electrode plate 1 and the developing roller 5*a* in one to-one correspondence and changes depending on the toner amount between the electrode plate 1 and the developing roller 5*a* (hereinafter referred to as the "output voltage corresponding to the toner remaining amount"), and an output voltage that corresponds to the capacitance of a toner-remaining-amount detecting capacitor in the developer-remaining-amount detecting circuit 17 (both the capacitor and the output value being at a constant value) (hereinafter referred to as the "fixed output voltage provided in the main body for comparative use").

In accordance with the present embodiment, the circuit that converts capacitance to voltage is arranged in which the smaller the toner between the developing roller 5*a* and the electrode plate 1, the larger the output voltage corresponding the toner remaining amount", and the capacitance becomes the maximum value when the toner does not exist at all.

In other words, the developing device 5, that is, the toner hopper 5*d* at the initial stage of use, is set at the relations of "the output voltage corresponding to the toner remaining amount"<"the fixed output voltage provided in the main body for comparative use". Then, the toner is reduced, and when the relations become "the output voltage corresponding to the toner remaining amount">"the fixed output voltage provided in the main body for comparative use", that is, when the large and small relationship is inverted, a warning is issued to indicate that the toner amount is reduced to the extent that the "blank areas" should be created in an image, that is, the toner amount has been reduced to a predetermined amount.

Figure 3:
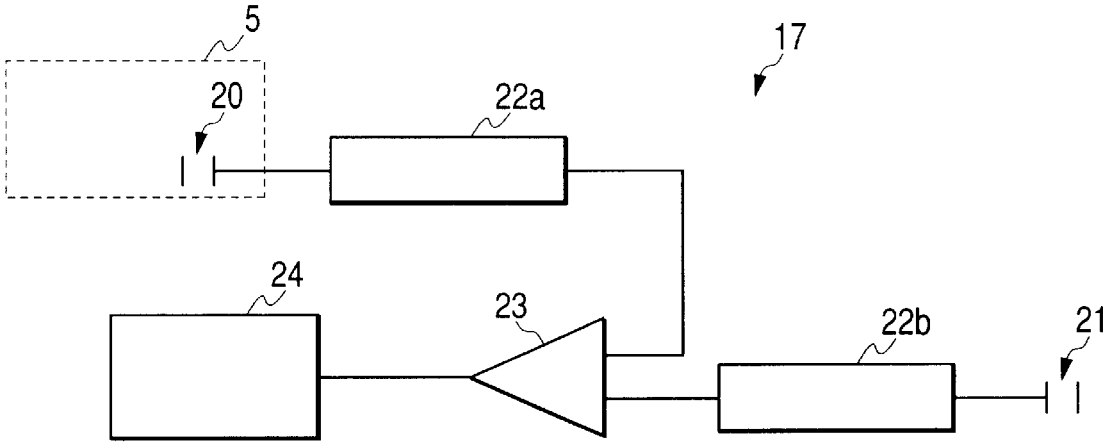
FIG. 3 is a circuit diagram which schematically shows one embodiment of a developer-amount detecting device in accordance with the present invention.

Here, in conjunction with FIG. 3, a description will be provided of the developer-remaining-amount detecting circuit 17 that includes the comparing circuit described above.

In the developing device 5, the capacitance induced by the capacitor 20, that is, a capacitor consisting of the developing roller 5*a* and the electrode plate 1, is converted into a voltage value in a one to one relationship by the converting circuit 22*a* and the voltage value is inputted into the comparing circuit 23. Also, the capacitor 21, which is installed in advance in the developer-remaining-amount detecting circuit 17, uses likewise a converting circuit 22*b* to convert the capacitance thereof into a voltage value in a one to one relationship, and the voltage value is inputted into the comparing circuit 23.

The comparing circuit 23 outputs the difference between these two voltage values, and the value of such difference is transmitted to a controller 24 for determining whether or not a warning should be issued so as to indicate that the toner amount is reduced to the extent of the "blank areas" being created in an image, that is, to indicate that the toner has been reduced to the predetermined amount.

The controller 24 is provided with a CPU; a ROM that stores the control program for the CPU and various kinds of data; and a RAM which is used as the working area of the CPU, at the same time, storing various kinds of data temporarily.

Figure 4:
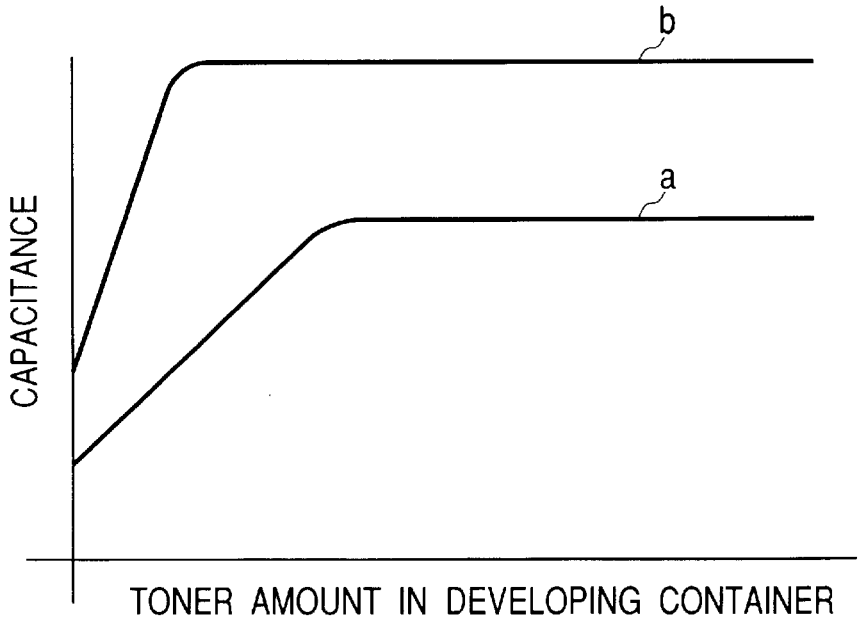
FIG. 4 is a graph which shows a relationship between a toner amount in a developing container and capacitance in accordance with the embodiment of the present invention and the conventional example.

FIG. 4 shows the output transition "a" of the conventional developer-remaining-amount detecting device and the output transition "b" of the developer-remaining-amount detecting device of the present embodiment.

From the representation of FIG. 4, it is understandable that the output transition "b" of the developer-remaining-amount detecting device of the present embodiment has a drastically larger change in capacitance, that is, the capacitance with respect to the unit change in toner amount (the amount of consumption) immediately before the creation of the "blank areas in an image". In other words, in accordance with the present embodiment, it becomes possible to significantly enhance the detection accuracy of the developer-remaining-amount detecting device.

Here, mainly the following two points can be referred to as the reasons why the detection accuracy can be enhanced as described above so as to make it possible to detect that the toner amount is reduced to the extent that the "blank areas" should be created in an image, that is, the toner amount has been reduced to the predetermined amount;

1) The sensitivity of the capacitor becomes higher as the distance between electrodes becomes smaller. In other words, in accordance with the present embodiment, the electrode plate 1 is arranged in the vicinity of the developing roller 5*a*, and the change in capacitance is large between the presence and the absence of toner.

2) The toner which is consumed immediately before the creation of the "blank areas in an image" is the one residing on the portion indicated by the reference sign E in FIG. 2. Unlike the conventional structure which needs a sensitivity of detection over all, that of the present embodiment is such that the portion indicated by the reference sign E where the toner is consumed when the toner amount is reduced to the extent that the "blank areas" should be created in an image, that is, the toner amount is reduced to the predetermined amount, is emphatically detected, thus making the detection accuracy higher.

In other words, in accordance with the present embodiment, the distance between electrodes that constitute a capacitor is made small, thereby making the sensitivity of detection higher. Then, the structure is arranged so that the toner is emphatically detected in the portion E in FIG. 2, that is, in the vicinity of the distal end of the developing blade, where toner is consumed when the toner is reduced to the extent that the "blank area" should be created in an image, or the toner amount is reduced to the predetermined amount. As a result, it becomes possible to enhance the detection accuracy up to make detection possible to the extent that the "blank areas" should be created in an image or the toner amount is reduced to the predetermined amount.

Further, it becomes possible to detect the toner that may reside between the electrode and a regulating member if the toner flows between the electrode and the regulating member, because such toner resides within the detectable range between the electrode and the developing roller. However, the toner that resides between the electrode and the regulating member is rarely used for development immediately. Therefore, in order to make the accuracy of detection higher, there is a need for lowering the sensitivity of detection in this particular portion or there is a need for designing the device so that no toner flows in this portion.

For the present embodiment, the higher accuracy of the toner-remaining-amount detection is implemented by arranging the structure so that no toner flows in between the electrode and the regulating member.

From the same point of view, not only the electrode, but also the container itself is structured so as not to allow toner to flow in the backside of the regulating member.

Figure 5A:
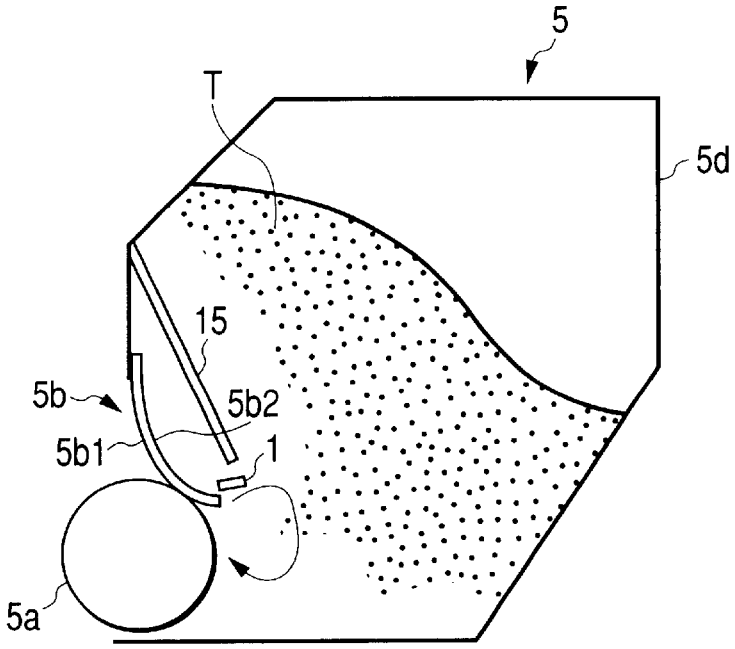
FIGS. 5A and 5B are views which illustrate the circulation route of toner in the developing device shown in FIG. 2.
Figure 5B:
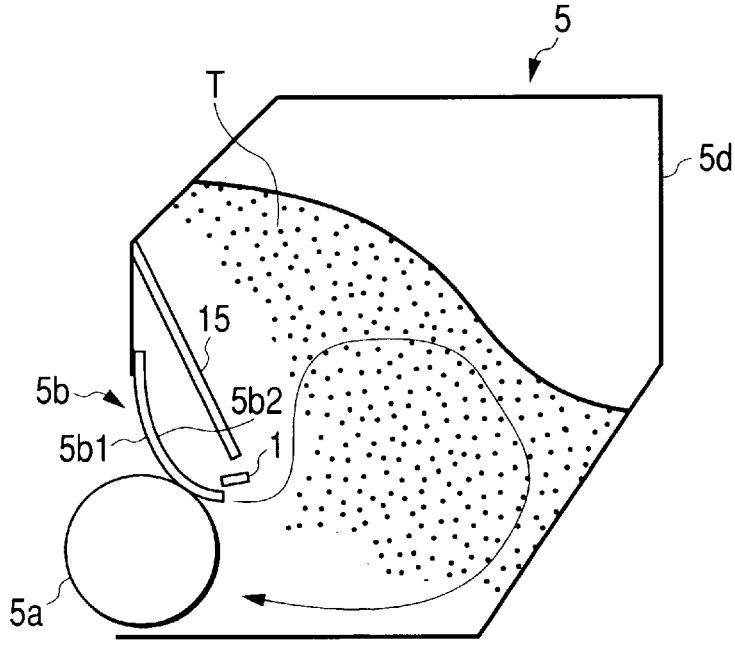

Also, with the aforesaid structure thus arranged, the circulation of toner is examined. Then, it is confirmed that there is no circulation which is extremely small nor any abnormal circulation, such as a short supply of toner to the developing roller 5*a*, as shown in FIG. 5A. It is confirmed that the toner circulation is all normal as shown in FIG. 5B.

As a result, it becomes possible to obtain good images during an endurance operation.

As described above, in accordance with the present embodiment, it is possible to enhance the detection accuracy to the extent that the "blank areas" should be created in an image or the toner amount is reduced to the predetermined amount without spoiling the quality of images.

Here, for the present embodiment, the electrode plate, that is, an electrode member shaped in a flat configuration, is used as the electrodes, but any other configuration may be adoptable if only it can guide the toner.

Figure 6A:
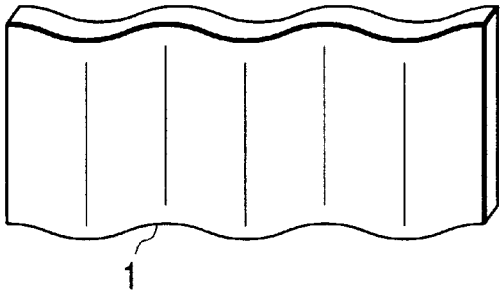
FIGS. 6A and 6B are perspective views which illustrate another embodiment of an electrode plate.
Figure 6B:
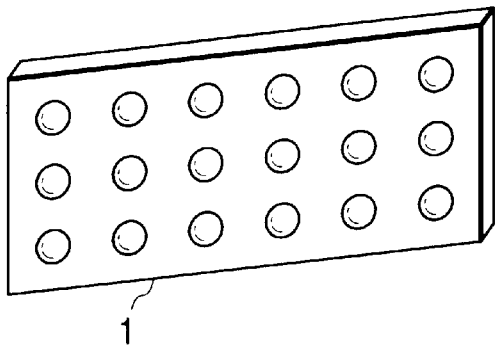

Also, for the electrode plate 1, it may be possible to make the surface of the electrode plate 1 corrugated as shown in FIG. 6A in order to enhance the capacitance-detection sensitivity or to make the electrode plate 1 embossed as shown in FIG. 6B in order to increase the opposing area of the electrode plate 1 to the developing roller 5*a*.

Figure 7A:
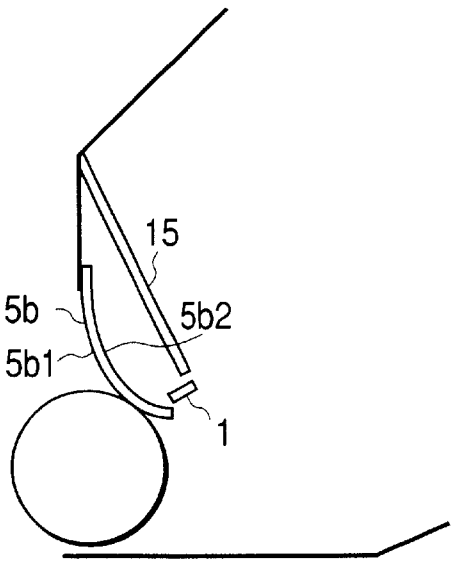
FIGS. 7A, 7B, and 7C are views which illustrate another example of the structural arrangement of the electrode plate.
Figure 7B:
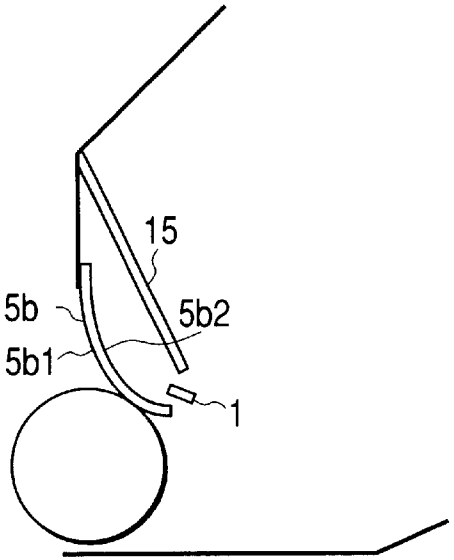
Figure 7C:
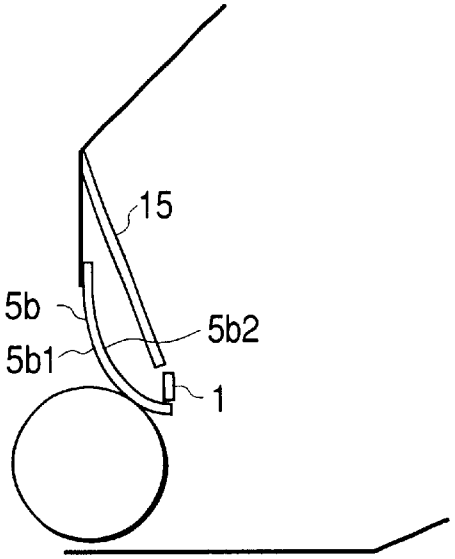

Further, the arrangement structure of the electrode plate 1 may be as shown in FIG. 7A, 7B, or 7C, besides the one shown in FIG. 2. The same effect is obtainable.

In other words, the electrode plate 1 shown in FIG. 7A is arranged so that one end thereof in the widthwise direction is in contact with the distal end of the developing blade 5*b* from above, and that the developing blade 5*b* is entirely inclined toward the upper right side in FIG. 7A.

The electrode plate 1 shown in FIG. 7B is arranged so that one end thereof in the widthwise direction is in contact with the distal end of the developing blade 5*b* from above, and that the developing blade 5*b* is entirely inclined toward the lower right side.

The electrode plate 1 shown in FIG. 7C is arranged in the vertical direction so that one end thereof in the widthwise direction is in contact with the distal end of the developing blade 5*b* from above.

In this respect, for each of the embodiments described earlier, a part of the electrode plate 1 may be in contact with the blade 5*b* so as not to allow toner to flow in between the electrode plate 1 and the blade 5*b*. Also, with the provision of a member, such as a sponge, between the electrode plate 1 and the blade 5*b*, it may be made compatible to prevent the toner from flowing into the back side 5*b*2 of the blade 5*b*, and to guide the toner in the direction away from the roller 5*a*.

The toner scraped off by the blade 5*b* is often agglomerated by the force exerted when being scraped off to become a large agglomeration. It is conceivable, therefore, that the toner moves as a large agglomeration for a while, and that even if there is a gap (approximately 5 mm, for instance) between the electrode plate 1 and the blade 5*b*, the toner is not allowed to flow into such gap.

Also, for the developing device 5 of the present embodiment, the magnetic developer that contains a magnetic member is used as the developer T, but the non-magnetic developer that does not contain any magnetic member is usable as the developer T. As a result, it is possible to form the developing device 5 as the magnetic mono-component developing device that uses the developer that involves a magnetic carrier itself as in the case of the present embodiment, but it is also possible to adopt the mode of a two-component developing device having a magnetic carrier or the mode of the non-magnetic one-component developing device which does not use any magnetic carrier.

These developers used for the developing device are produced by a pulverizing method or a polymerizing method. For the developing device of the present embodiment, the developer having a small average particle diameter (a developer having the average particle diameter of approximately 5 $\mu$m to 7 $\mu$m, for instance) is used to make it possible to reproduce fine images.

Embodiment 2

Figure 8:
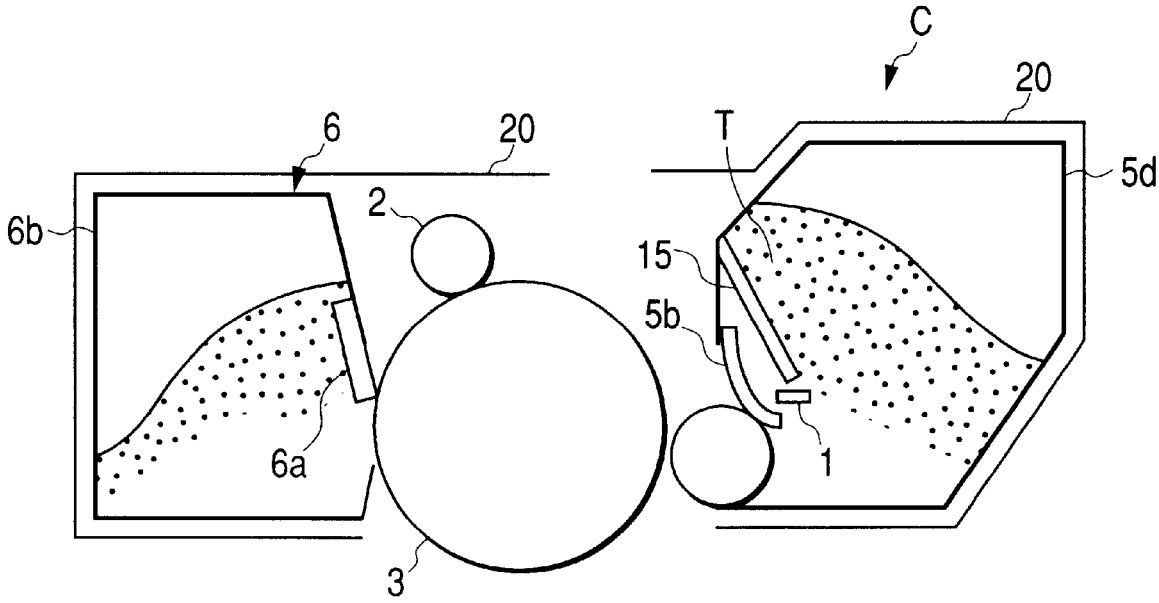
FIG. 8 is a view which schematically shows one embodiment of a process cartridge in accordance with the present invention.
Figure 9:
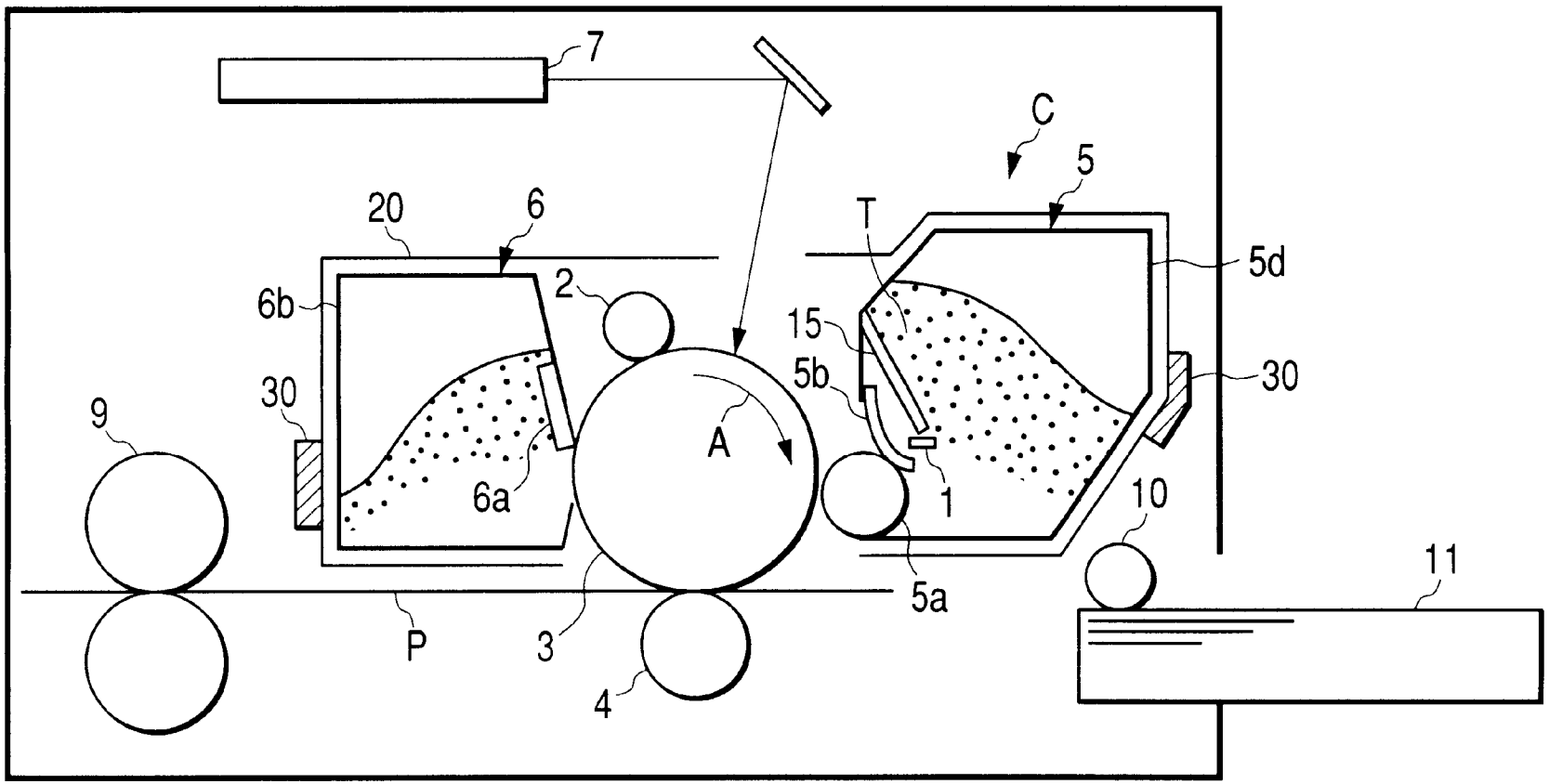
FIG. 9 is a view which schematically shows one embodiment of an electrophotographic image forming apparatus having the process cartridge of the present invention mounted thereon.
Figure 10:
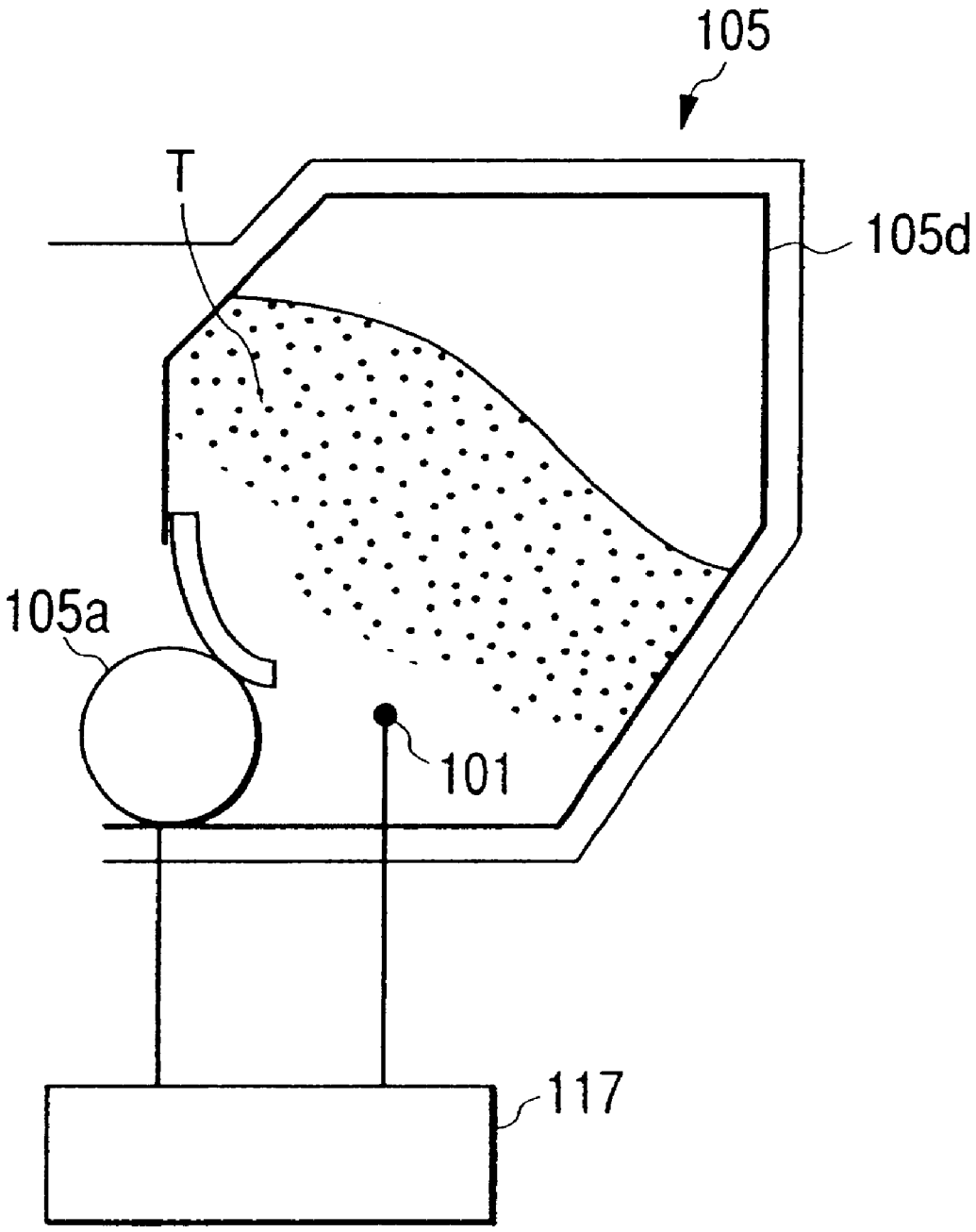
FIG. 10 is a view which schematically shows the conventional developing device and the developer-amount detecting device therefor.
Figure 11:
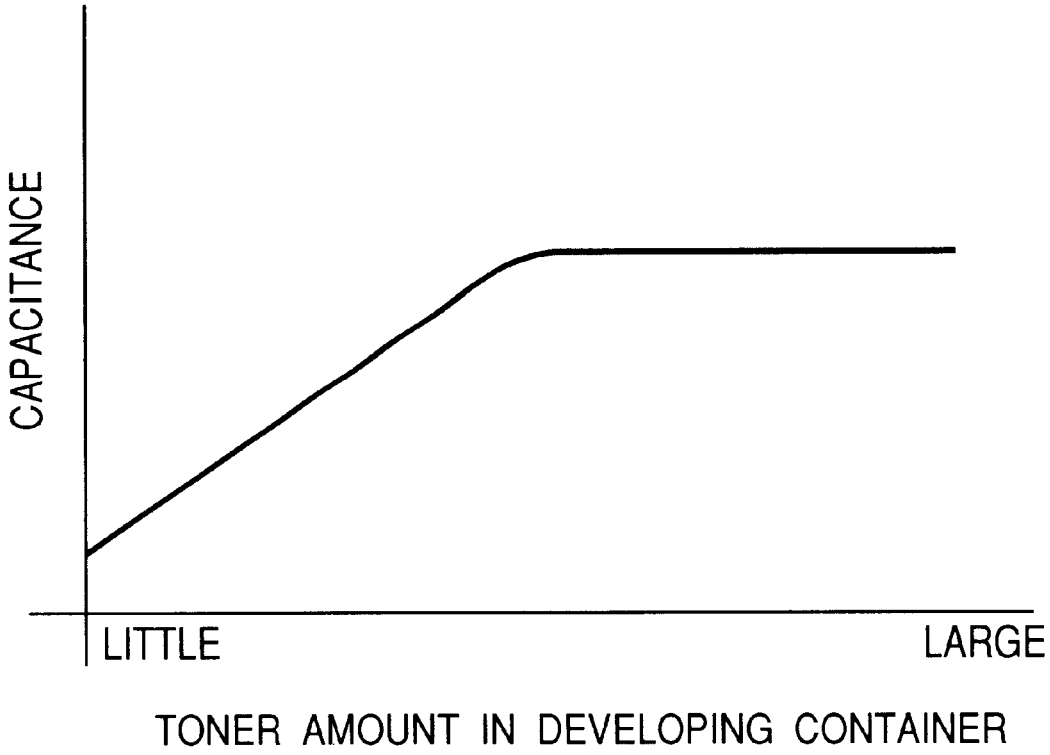
FIG. 11 is a graph which shows a relationship between a toner amount in a developer container and capacitance.

Next, in conjunction with FIG. 8 and FIG. 9, a description will be provided of the electrophotographic image forming apparatus in accordance with the second embodiment. In this respect, the same reference marks are applied to the same members that have already been described, and the description thereof will be omitted.

For the second embodiment, the developing device 5 of the first embodiment is arranged to be a process cartridge C into which the photosensitive drum 3, the charging device 2, and the cleaning device 6 are integrated by a frame 20. Then, the process cartridge is detachably mountable on the main body of an electrophotographic image forming apparatus through mounting means 30.

The process cartridge C is designed to use up the life thereof almost simultaneously with the other structural members when the toner T inside the hopper 5*d* is depleted.

Therefore, the user can obtain images stably at all times as far as the toner T remains inside the process cartridge C. Furthermore, being integrally formed, the process cartridge has an advantage that it can be replaced with ease.

Then, with the application of the characteristic features of the present invention to the developing device 5 of the process cartridge C, it becomes possible to use toner effectively without any trouble on the part of user, because in addition to the fundamental advantages of the process cartridge, the creation of the "blank areas in an image" can be detected with a higher accuracy, while exerting no influence on images.

As clear from the above description, the present invention makes it possible to detect the reduction of toner to the predetermined amount without exerting any influence on images.

While the invention has been described with reference to the structure disclosed herein, it is not confined to the details set forth, and this application is intended to cover such modifications or changes as may come within the purposes of the improvements or the scope of the following claims.

What is claimed is:

1. A developing device to be used for a main body of an electrophotographic image forming apparatus to develop an electrostatic latent image formed on an electrophotographic photosensitive member, said developing device comprising:

a developer bearing member for supplying developer to said electrophotographic photosensitive member to develop the electrostatic latent image formed on said electrophotographic photosensitive member;

a developer regulating member for regulating the amount of developer adhering to a surface of said developer bearing member;

an electrode member arranged in a traveling route of the developer removed from the surface of said developer bearing member by said developer regulating member to guide the traveling developer in a direction away from said developer bearing member;

an output member for outputting a voltage value corresponding to the amount of developer between said developer bearing member and said electrode member in order to detect the developer remaining amount; and a developer in-flow restricting member arranged for preventing the developer from flowing into a side of a surface of said developer regulating member opposite to a surface of said developer regulating member opposed to said developer bearing member, wherein said developer in-flow restricting member cooperates with said developer regulating member and said electrode member to define an enclosed space, into which no developer flows.

2. A developing device according to claim 1, wherein said electrode member has a flat shape.

3. A developing device according to claim 1, wherein said electrode member is a separate member from said developer in-flow restricting member and arranged with a gap to said developer in-flow restricting member.

4. A developing device according to any one of claim 1, 2, or 3, wherein a capacitor consists of said developer bearing member and said electrode member, and the developer remaining amount is detected based on a capacitance value of said capacitor, the capacitance value changing depending on the amount of developer between said developer bearing member and said electrode member.

5. A process cartridge detachably mountable on a main body of an electrophotographic image forming apparatus, said process cartridge comprising:

(a) an electrophotographic photosensitive member;

(b) a developing device including: a developer bearing member for supplying developer to said electrophotographic photosensitive member to develop an electrostatic latent image formed on said electrophotographic photosensitive member; a developer regulating member for regulating the amount of developer adhering to a surface of said developer bearing member; an electrode member arranged in a traveling route of the developer removed from the surface of said developer bearing member by said developer regulating member to guide the traveling developer in a direction away from said developer bearing member; an output member for outputting a voltage value corresponding to the amount of developer between said developer bearing member and said electrode member in order to detect the developer remaining amount; and a developer in-flow restricting member arranged for preventing the developer from flowing into a side of a surface of said developer regulating member opposite to a surface of said developer regulating member opposed to said developer bearing member, wherein said developer in-flow restricting member cooperates with said developer regulating member and said electrode member to define an enclosed space, into which no developer flows.

6. A process cartridge according to claim 5, wherein said electrode member is a separate member from said developer in-flow restricting member and is arranged with a gap to said developer in-flow restricting member.

7. A process cartridge according to claim 5, wherein said electrode member has a rod shape.

8. A process cartridge according to any one of claim 5, 6, or 7, wherein a capacitor consists of said developer bearing member and said electrode member, and the developer remaining amount is detected based on a capacitance value of said capacitor, the capacitance value changing depending on the amount of developer between said developer bearing member and said electrode member.

9. An electrophotographic image forming apparatus for forming an image on a recording medium, said apparatus comprising:

(a) an electrophotographic photosensitive member;

(b) electrostatic latent image forming means for forming an electrostatic latent image on said electrophotographic photosensitive member; and (c) a developing device for developing the electrostatic latent image formed on said electrophotographic photosensitive member, said developing device including: a developer bearing member for supplying developer to said electrophotographic photosensitive member; a developer regulating member for regulating an amount of developer adhering to a surface of said developer bearing member; an electrode member arranged in a traveling route of the developer removed from the surface of said developer bearing member by said developer regulating member to guide the traveling developer in a direction away from said developer bearing member; an output member for outputting a voltage value corresponding to the amount of developer between said developer bearing member and said electrode member in order to detect the developer remaining amount; and a developer in-flow restricting member arranged for preventing the developer from flowing into a side of a surface of said developer regulating member opposite to a surface of said developer regulating member opposed to said developer bearing member, wherein said developer in-flow restricting member cooperates with said developer regulating member and said electrode member to define an enclosed space, into which no developer flows.

10. An electrophotographic image forming apparatus to which a process cartridge is detachably mountable for forming an image on a recording medium, said apparatus comprising:

(a) mounting means for detachably mounting said process cartridge, said process cartridge including: an electrophotographic photosensitive member; and a developing device, said developing device having: a developer bearing member for supplying developer to said electrophotographic photosensitive member to develop an electrostatic latent image formed on said electrophotographic photosensitive member; a developer regulating member for regulating an amount of developer adhering to a surface of said developer bearing member; an electrode member arranged in a traveling route of the developer removed from the surface of said developer bearing member by said developer regulating member to guide the traveling developer in a direction away from said developer bearing member; an output member for outputting a voltage value corresponding to the amount of developer between said developer bearing member and said electrode member in order to detect the developer remaining amount; and a developer in-flow restricting member arranged for preventing the developer from flowing into a side of a surface of said developer regulating member opposite to a surface of said developer regulating member opposed to said developer bearing member, wherein said developer in-flow restricting member cooperates with said developer regulating member and said electrode member to define an enclosed space, into which no developer flows; and (b) electrostatic latent image forming means for forming the electrostatic latent image on said electrophotographic photosensitive member.

11. An electrophotographic image forming apparatus according to claim 9 or 10, wherein said electrode member has a flat shape.

12. An electrophotographic image forming apparatus according to claim 9 or 10, wherein said electrode member is a separate member from said developer in-flow restricting member and is arranged with a gap to said developer in-flow restricting member.

13. An electrophotographic image forming apparatus according to claim 9 or 10, wherein a capacitor consists of said developer bearing member and said electrode member, and the developer remaining amount is detected based on a capacitance value of said capacitor, the capacitance value changing depending on the amount of developer between said developer bearing member and said electrode member.

* * * * *

UNITED STATES PATENT AND TRADEMARK OFFICE

CERTIFICATE OF CORRECTION

PATENT NO. : 6,512,897 B2
DATED : January 28, 2003
INVENTOR(S) : Hideki Matsumoto It is certified that error appears in the above-identified patent and that said Letters Patent is hereby corrected as shown below:

Column 4,
Line 29, “uiformly” should read -- uniformly --.

Column 5,
Line 5, “one to-one” should read -- one-to-one --.

Column 8,
Line 22, “of” should read -- of the --.

Column 9,
Line 15, “member;” should read -- member; and --.

Signed and Sealed this

Eleventh Day of November, 2003

JAMES E. ROGAN
*Director of the United States Patent and Trademark Office*